US007866885B2

(12) United States Patent
Kujat et al.

(10) Patent No.: US 7,866,885 B2
(45) Date of Patent: Jan. 11, 2011

(54) FILM BAG

(75) Inventors: Marcus Kujat, Osnabrück (DE); Alfons Kruse, Dinklage (DE)

(73) Assignee: Nordenia Deutschland Halle GmbH, Halle (DE)

( * ) Notice: Subject to any disclaimer, the term of this patent is extended or adjusted under 35 U.S.C. 154(b) by 865 days.

(21) Appl. No.: 11/824,272

(22) Filed: Jun. 29, 2007

(65) Prior Publication Data

US 2008/0013866 A1 Jan. 17, 2008

(30) Foreign Application Priority Data

Jul. 1, 2006 (EP) ..... 06013692

(51) Int. Cl.
*B65D 33/06* (2006.01)
*B65D 33/16* (2006.01)
*B65D 30/08* (2006.01)

(52) U.S. Cl. ..... 383/6; 383/17; 383/26; 383/63; 383/66; 383/109

(58) Field of Classification Search ..... 383/17, 383/20, 26, 28, 6, 66, 63, 109
See application file for complete search history.

(56) References Cited

U.S. PATENT DOCUMENTS 3,490,681 A * 1/1970 Niemeyer ..... 383/20
3,504,845 A * 4/1970 Niemeyer ..... 383/20
3,507,194 A * 4/1970 Schwarzkopf ..... 493/196
3,850,724 A 11/1974 Lehmacher
6,899,663 B2 5/2005 Tetenborg

FOREIGN PATENT DOCUMENTS

DE 93 05 817 U1 10/1993
DE 101 37 844 A1 2/2003
GB 1180237 2/1970
WO WO 2005/113357 12/2005

* cited by examiner

*Primary Examiner*—Jes F Pascua
(74) *Attorney, Agent, or Firm*—Collard & Roe, P.C.

(57) ABSTRACT

A film bag that forms a sealed film package, with bag surfaces made of an at least two-layered composite film that has a heat-sealable polyolefin inner layer and a non-sealable outer layer. There is at least one carrying handle made of a heat-sealable film. The bag surfaces have window-like openings spaced away from the edges of the film bag, which are covered by film tabs on the inside of the bag. The film tabs are sealed by a heat-sealable first side to the layer of the bag surfaces on the inside of the bag, and each is joined to it by a sealing seam that surrounds the associated opening as an air-tight closure. Each of the ends of the at least one carrying handle is sealed in the region of the openings to the heat-sealable first side of the film tabs covering the openings.

4 Claims, 3 Drawing Sheets

FILM BAG

BACKGROUND OF THE INVENTION

1. Field of the Invention

The invention relates to a film bag that forms a sealed film package, with bag surfaces made of a composite film with at least two layers consisting of a heat-sealable polyolefin inner layer and a non-sealable outer layer. There is at least one carrying handle made of a heat-sealable film. The film package is suitable particularly for packaging pourable products, for example such as pelletized animal food, detergents, kitty litter, deicing salt, or powdered or granular construction materials. Even large and heavily loaded film bags can be transported easily with the help of the carrying handle.

2. The Prior Art

A film bag designed as a carrying bag is disclosed by German Patent No. DE 101 37 844 A1. Fastened to the inside of the film bag are reinforcing strips to which carrying handles inside the bag are sealed. The carrying handles extend through the open edge of the carrying bag at the top.

A film bag in the form of a carrying bag is also disclosed by UK Patent No. GB 1 180 237 A. The carrying handles are located on the outside of the bag and are connected to reinforcing elements on the inside of the bag through window-like openings in the surfaces of the film bag. The reinforcing elements are not fastened to the inside of the film bag. In an exemplary embodiment shown in FIG. 1, the reinforcing elements consist of a strip that is connected at both ends to the ends of a carrying handle and forms a loop with it. In an exemplary embodiment shown in FIG. 3, the reinforcing elements consist of short flexible segments that can be folded and can be passed through the window-like openings. This makes it possible to remove the handle from the carrying bag.

A sealed packaging bag designed as a side-fold bag made of paper or plastic is disclosed by German Patent No. DE 93 05 817 U1. A carrying handle is provided at the top of the packaging bag, which handle is glued into an adhesive region connecting the two surfaces of the bag.

SUMMARY OF THE INVENTION

It is therefore an object of the invention to provide a sealed film package with which a flexible arrangement of a carrying handle located on the outside is possible, with a largely free configuration of the outside of the bag. A solid connection between the carrying handle and the composite film of the film bag is also to be provided. The fastening of the carrying handle, finally, must not impair the tightness of the film package.

The object of the invention and the solution to this problem is a film bag that forms a sealed film package, with bag surfaces made of a composite film with at least two layers that has a heat-sealable polyolefin inner layer and a non-sealable outer layer, and with at least one carrying handle made of a heat-sealable film. The surfaces of the bag have window-like openings spaced away from the edges of the film bag that are covered on the inside of the bag by film tabs. The film tabs are sealed with a heat-sealable first side to the inside layer of the surfaces of the bag, and each is joined to this by a sealing seam that surrounds the associated opening as an air-tight closure. The ends of the at least one carrying handle in each case are sealed in the region of the openings to the heat-sealable first side of the film tab covering the openings.

The openings and thus also the ends of the at least one carrying handle can be positioned anywhere on the bag surfaces of the film bag, for example on the front surfaces. Since neither the film tabs nor the ends of the carrying handle are connected to the outer surface of the film bag, composite films that can be set largely freely with regard to the outside material are suitable for the film bags.

The configuration of the film package pursuant to the invention makes possible secure fastening of the at least one carrying handle even when direct sealing of the carrying handle to the outside surface of the film is detrimental or impossible. Thus, the outer surface of the composite film can have a non-sealable polymer composition, or a composition that is sealable only with difficulty, and/or a coating of printing ink or protective varnish. The film tabs must overlap the particular associated opening such that a sufficient region of overlap of the film tab on the film bordering the opening is available for heat-sealing. Each of the film tabs is fastened to the inside layer of the bag surface by a continuous unbroken sealing seam that surrounds the associated opening. A continuous unbroken sealing seam guarantees a high load capacity and also makes possible an air-tight closure of the opening. The shape of the openings and of the film tabs is not limited in the context of the invention. The openings and film tabs can be made round, polygonal, or oval, for example.

One end of each carrying handle is preferably associated with exactly one film tab. Basically, however, other configurations are also possible. For example, two openings in one of the front walls can also be covered by a common film tab sealed onto the inner surface of the film. A configuration is also preferred in which the film bag has two carrying handles, with one handle being located on each front surface of the film bag. Uniform weight distribution is achieved by such an arrangement, and the upper edge of the film bag is readily accessible.

The sealed film package can be opened at its top. According to a preferred embodiment of the invention, a section of the bag has a reseal closure above the ends of the at least one carrying handle. The reseal closure is suitably placed on the heat-sealable inner surface of the film. Such a reseal closure typically has two strip-shaped closure elements, with one of the closure elements having a groove that engages with clamping effect in a projection of the other closure element. To facilitate opening and closing motions, a slider can also be provided. After the film package is first torn open, the reseal closure makes it possible to seal it again, whereby the storability of the product remaining in the bag can be improved. In contrast to known film bags, in which the carrying handle extends out from the inside of the bag at the top end of the bag, the configuration pursuant to the,invention makes possible a largely independent and free positioning of the reseal closure and the carrying handle(s), so that the production and handling of the film bag are facilitated.

In the context of the invention, each end of the at least one carrying handle can be joined to the associated film tab by an unbroken sealing seam. As with the sealing seam described above between the film tab and the inside layer of the film bag, this unbroken sealing seam can be round, oval, or rectangular, preferably with rounded corners. A continuous unbroken and sufficiently wide sealing seam guarantees secure fastening of the ends of the at least one carrying handle to the associated film tabs.

The first side of the film tab and the heat-sealable layer on the inside of the bag, and/or the first side of the film tab and the associated side of the carrying handle sealed onto the film tab, are preferably made of the same polymer or of a polymer of the same type, to guarantee good sealability. The film tab and the carrying handle can be coextruded or laminated in two or more plies. In the context of the invention, the film tab, the composite film of the film bag, and the carrying handle can have the same structure. However, the thickness, structure, and composition of the film tab, of the composite film of the film bag, and of the at least one carrying handle are preferably tailored precisely to their particular functions. Thus, for example, the film tab and/or the at least one carrying handle in particular can also be made of a multilayered, coextruded or laminated film or can be fiber-reinforced to increase their carrying power. Since the load capacity of the carrying handle is distributed two-dimensionally through the film tab to the front walls, a very uniform force distribution can be achieved.

The composite film of the film bag must have adequate sealability on its inner surface to be joined to the film tabs. The composite film, for example, has an inner layer of a polymer from the group consisting of polyethylene (PE), polypropylene (PP), polyethylene copolymer, polypropylene copolymer, or blends of these polymers, and an outer layer of a polymer from the group consisting of polyethylene terephthalate (PET) or biaxially oriented polypropylene (BO-PP). The inner layer has very good sealability, especially if the first side of the heat-sealable film tab consists of the same polymer or is based on the same polymer. The outer layer does not have to be sealable. Both PET and BO-PP are distinguished by good imprintability and good mechanical properties. An imprint can be provided in that case on the outside, or in the case of a laminated film, on the inside of the second film layer constituting the outer surface. Other functional layers or adhesion-promoting layers can also be placed between the first film layer and the second film layer. The sealable first film layer preferably has a lower melting point than the second film layer, so that only the first film layer melts at a suitable sealing temperature. The melting point in this case can be set precisely by the choice of a copolymer or of a polymer blend.

Since the outer surface of the film from which the film bag is manufactured can be configured with great freedom, the outside of the bag in the context of the invention can have an especially attractive, high-quality appearance. In order not to reduce the high-quality image of the film bag, it is preferable for the ends of the at least one carrying handle to completely cover the particular associated openings on the outside of the bag, so that the film tab located beneath it cannot be seen. From its ends, the carrying handle extends outside of the associated front wall. It bounds the front wall when the film bag is tightly filled and heavily loaded, so that the upper edge of the film bag is supported and the risk of the carrying handle tearing off is reduced. The carrying handle can consist of a simple strip of film. It can be angled at its central section or it can run along a U-shaped arc.

In a preferred embodiment of the invention, the film bag is formed by folding and sealing the film as a side-fold bag, and has side folds that connect the lateral edges of the front walls. In the context of this embodiment, the film bag when filled is somewhat square in shape and can thus be carried and set down easily and in a small space.

In an alternative embodiment of the invention, two front surfaces are connected directly to one another along sealing seams on the edges.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
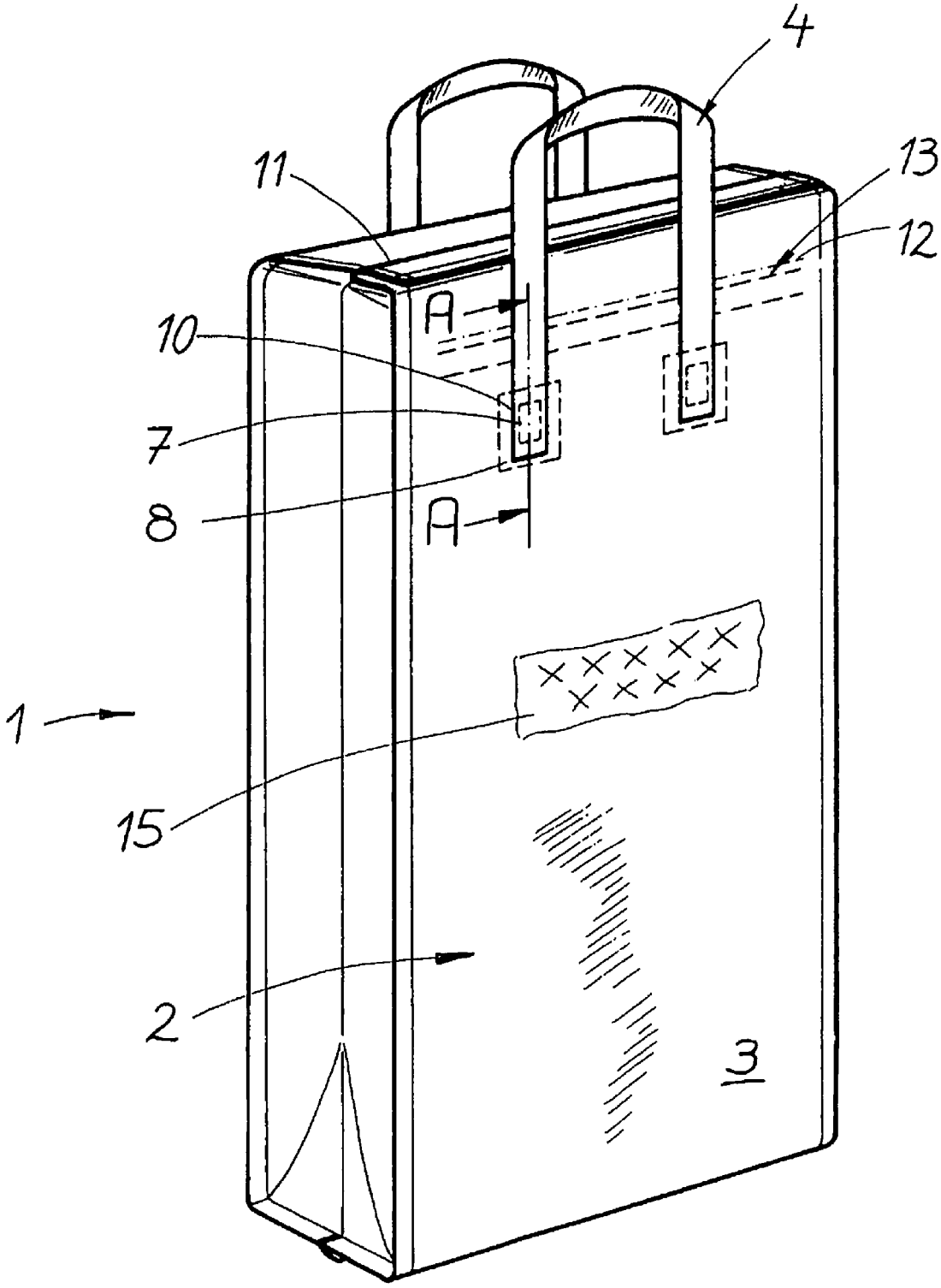
FIG. 1 shows a film bag pursuant to the invention that forms a sealed film package.

Referring now in detail to the drawings and, in particular, FIG. 1 illustrates a film bag 1 designed as a film packaging bag with two front walls 3 formed from a film 2, and two heat-sealable carrying handles 4. Film 2 has a layer 5 inside the bag made of a heat-sealable material. Front walls 3, i.e., the surfaces of the bag, contain window-like openings 7 spaced away from the edges of film bag 1, each of which is covered by exactly one associated film tab 8. Each of film tabs 8 is sealed by a heat-sealable first side 9 to layer 5 of film 2 inside the bag in a region surrounding opening 7, with each end 10 of carrying handles 4 being sealed within an associated opening 7 to the heat-sealable first side 9 of film tab 8 covering opening 7. One of the front walls 3 is associated with each of carrying handles 4. The film bag 1 designed as a side-fold bag can be easily carried, set down, and stacked. Behind a weakening line 12, a reseal closure 13 with strip-shaped closure elements 14, 14' is placed on layer 5 of film 2 inside the bag, above openings 7 and below upper edge 11 of film bag 1 closed by a heat-sealing seam. Ends 10 of carrying handles 4 sealed to first side 9 of film tab 8 covering opening 7 within associated openings 7, cover openings 7 completely, so that film tabs 8 are not visible on the outside of the bag. Film bag 1 has an imprint 15 visible on the outside of the bag.

Figure 2:
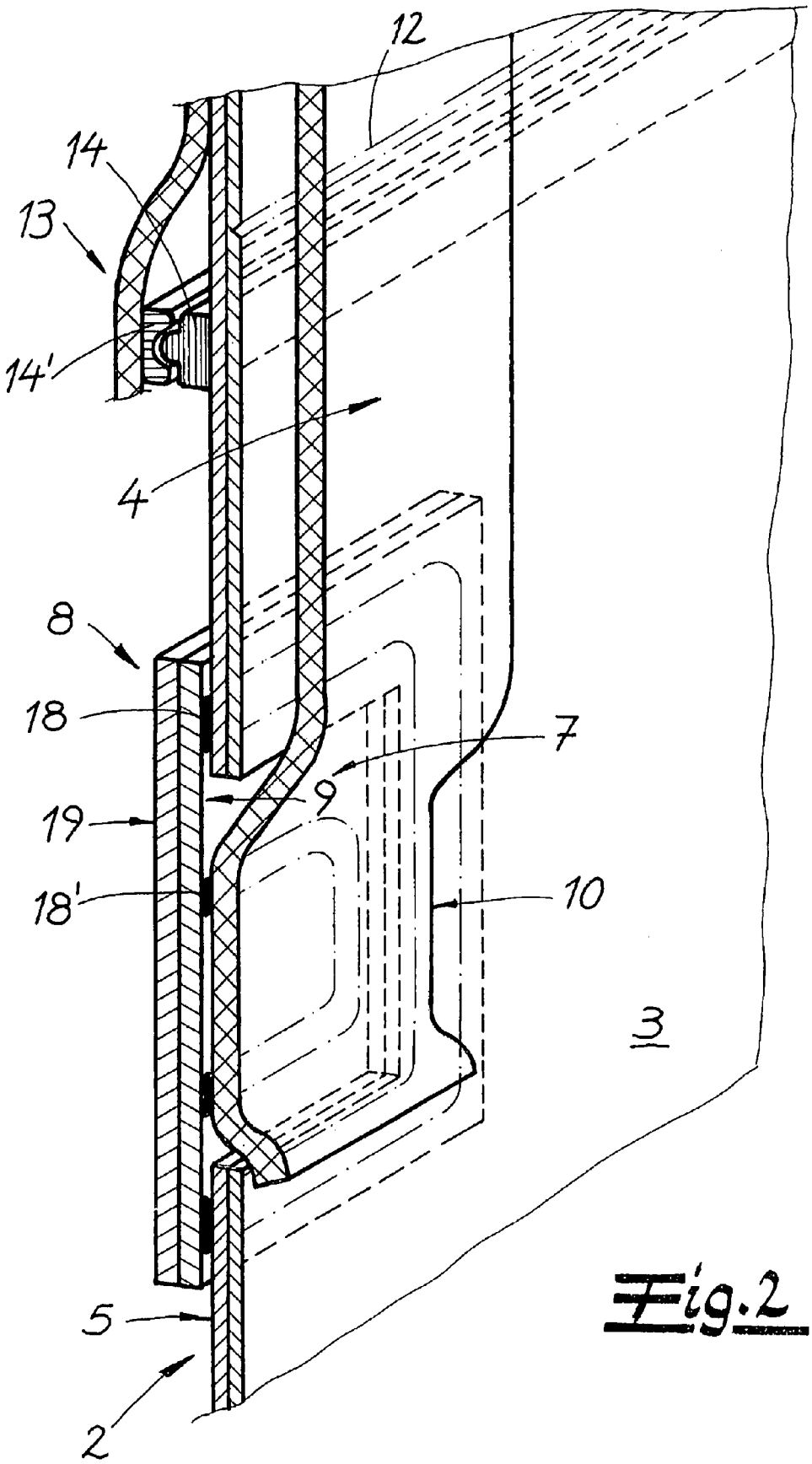
FIG. 2 shows a perspective cross-section along the line A-A of FIG. 1.

FIG. 2 shows the film bag illustrated in FIG. 1 in a perspective sectional view. Film 2 from which film bag 1 is folded and sealed consists of a composite film and has a layer 5 of a polyolefin, for example polyethylene (PE), on the inside of the bag, and an outer layer of polyethylene terephthalate (PET). The PET layer is printed on the side facing first layer 5. One or more intermediate layers, for example adhesion aids and barrier layers, can be placed between layer 5 inside the bag and the outer layer. The window-like, approximately rectangular opening 7 is covered on the inside of the bag by film tab 8, which overlaps opening 7 on the edges. Film tab 8 is fastened in the overlap region on its first side 9 to inside layer 5 of film 2 inside the bag, with a continuous unbroken sealing seam 18 that surrounds opening 7. Sealing seam 18 forms an air-tight closure. First side 9 of the film tab 8, like inner surface 5 of film 2, consists of polyethylene (PE), which guarantees good sealability. Film tab 8 is, of multilayered construction, and a barrier layer, for example made of PET, may be provided on a second side 19 facing the inside of the bag, for tight sealing of film bag 1. Carrying handle 4 consists, for example, of a polyethylene monofilm and is sealed at its end 10 on the outside of the bag to first side 9 of film tab 8 along a continuous unbroken sealing seam 18'. The reseal closure located above opening 7 behind weakening line 12 has a first strip-shaped closure element 14 with a projection that engages in a groove in the second strip-shaped closure element 14'. Closure elements 14, 14' are sealed to layer 5 of film 2 inside the bag at one of front walls 3, with second closure element 14' having a connecting segment for fastening to front wall 3.

Figure 3:
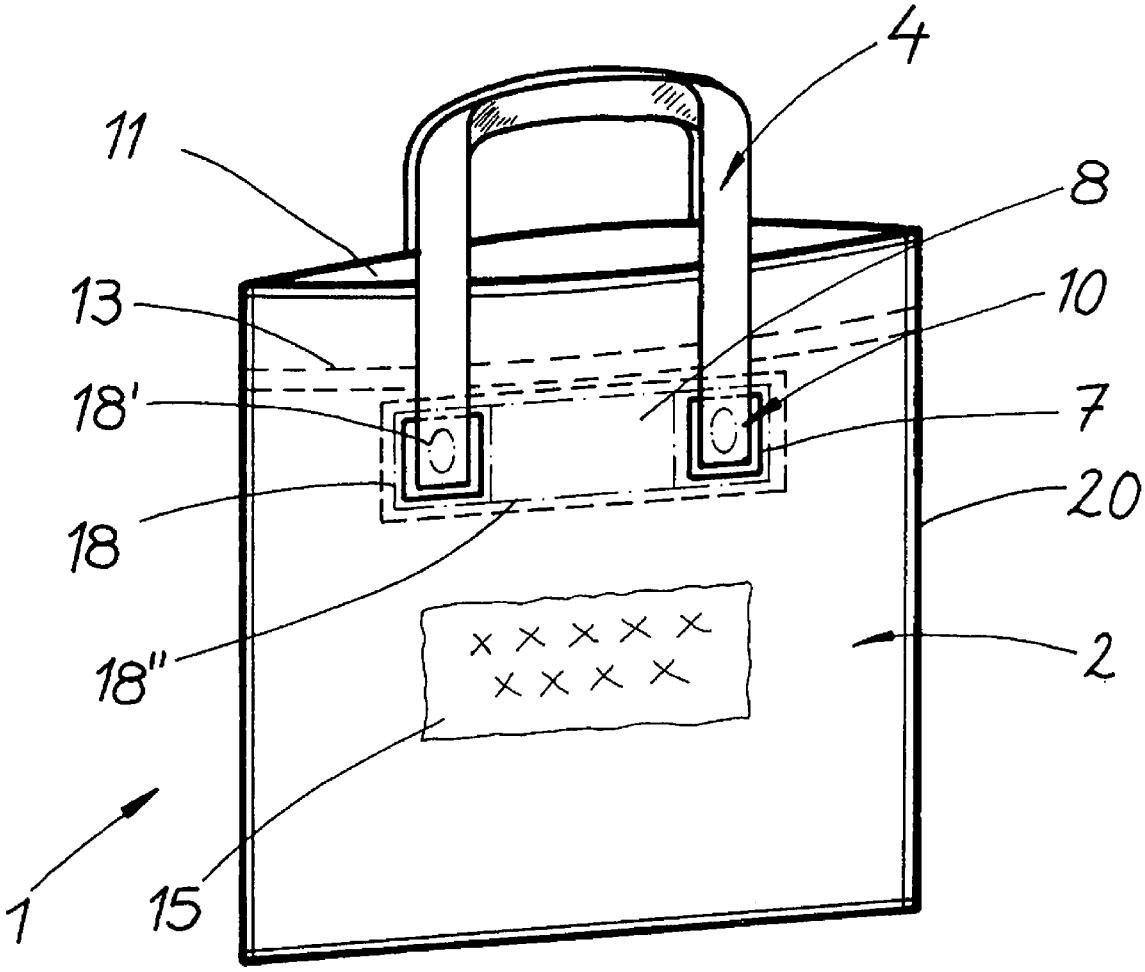
FIG. 3 shows another embodiment of the film bag pursuant to the invention.

FIG. 3 shows a film bag 1 in which front walls 3 are connected directly to one another at their edges along sealing seams 20. Ends 10 of carrying handles 4 do not completely cover openings 7, so that a film tab 8 covering both openings 7 on the inside of the bag is partly visible on the outside of the bag. Layer 5 of film 2 on the inside of the bag is made of a first film ply of a polypropylene (PP) blend or a polypropylene copolymer, with the printed outer surface of film 2 being formed of a second film ply of biaxially oriented polypropylene (BO-PP). The polymer of the first film ply is chosen so that it has a lower melting point than the second film ply and is distinguished by very good sealability. Film tab 8 shown in FIG. 2 and carrier handles 4 are made as monofilms from the same polymer as the first film ply. Openings 7 are surrounded on layer 5 of film 2 inside the bag by continuous unbroken sealing seams 18, by which film tab 8 is fastened to layer 5 of film 2 inside the bag. In addition, both of the approximately rectangular sealing seams 18 are connected by two horizontal sealing seams 18", by which film bag 1 achieves a very high carrying capacity. Each of ends 10 of carrying handle 4 is fastened to film tab 8 by an unbroken, approximately oval sealing seam 18'. There is a reseal closure 13 located above openings 7 with which film bag 1 open at its top edge 11 can be sealed.

Accordingly, while only a few embodiments of the present invention have been shown and described, it is obvious that many changes and modifications may be made thereunto without departing from the spirit and scope of the invention.

What is claimed is:

1. A film bag that forms a sealed film package, comprising:

a composite film comprising a heat-sealable polyolefin inner layer and a non-sealable outer layer; and at least one carrying handle made of a heat-sealable film, wherein surfaces of the bag have window-like openings spaced away from edges of the film bag, said openings being covered on an inside thereof by film tabs;

wherein the film tabs are sealed via a heat-sealable first side to the inner layer of the of the bag, and each tab is joined to said inner layer by a sealing seam that surrounds each associated opening as an air-tight closure, wherein ends of the at least one carrying handle are each sealed in a region of the openings to the heat-sealable first side of the film tab covering the openings.

2. A film bag according to claim 1, wherein each of the ends of the at least one carrying handle is connected to the associated film tab by an annular unbroken sealing seam.

3. A film bag according to claim 1, wherein a section of the bag has a reseal closure above the ends of the at least one carrying handle.

4. A film bag according to claim 1, wherein the inner layer is made of a polymer selected from the group consisting of polyethylene (PE), polypropylene (PP), polyethylene copolymer, polypropylene copolymer, and blends of these polymers, and the outer layer is made of a polymer selected from the group consisting of polyethylene terephthalate (PET) and biaxially oriented polypropylene (BO-PP).

* * * * *